US008567686B2

(12) United States Patent
Khalafi

(10) Patent No.: US 8,567,686 B2
(45) Date of Patent: Oct. 29, 2013

(54) SYSTEM AND METHOD FOR CREATING MULTIZONES FROM A SINGLE ZONE HEATING SYSTEM

(76) Inventor: Asghar Khalafi, Hooksett, NH (US)

( * ) Notice: Subject to any disclaimer, the term of this patent is extended or adjusted under 35 U.S.C. 154(b) by 702 days.

(21) Appl. No.: 12/869,467

(22) Filed: Aug. 26, 2010

(65) Prior Publication Data

US 2011/0062246 A1 Mar. 17, 2011

Related U.S. Application Data

(60) Provisional application No. 61/276,657, filed on Sep. 15, 2009, provisional application No. 61/263,374, filed on Nov. 22, 2009.

(51) Int. Cl.
*F24D 19/10* (2006.01)
*G05D 23/00* (2006.01)

(52) U.S. Cl.
USPC ..... 236/1 B; 236/51; 165/205

(58) Field of Classification Search
USPC ..... 236/1 B, 51; 165/205, 218, 219
See application file for complete search history.

(56) References Cited

U.S. PATENT DOCUMENTS

| | | | | |
|---|---|---|---|---|
| 4,969,508 | A * | 11/1990 | Tate et al. | 165/209 |
| 5,566,879 | A * | 10/1996 | Longtin | 236/46 R |
| 6,997,390 | B2 * | 2/2006 | Alles | 236/49.4 |
| 7,062,830 | B2 * | 6/2006 | Alles | 29/401.1 |
| 2005/0116055 | A1 * | 6/2005 | Alles | 236/49.1 |

* cited by examiner

*Primary Examiner* — Marc Norman

(57) ABSTRACT

The present invention features a multizone conversion system for converting a single zone system into a multizone system. The multizone conversion system is designed to require minimal renovations and does not require extensive new wiring. Each room within the new multizone system has its own thermostat controls and each room can be set to its own specific temperature. The multizone conversion system does not require new piping to and from the boiler. Each thermostat is equipped with a temperature sensing device, temperature setting controls, an LCD monitor or display and an RF circuit that includes an RF transmitter and an RF receiver. Each heating element within the room is outfitted with an input device that contains an RF circuit, a switching valve and a battery compartment. The thermostat communicates wirelessly with the output device located in the room and control the flow of the heated water through the existing heating element or alternatively through a bypass pipe if heat is not required.

9 Claims, 5 Drawing Sheets

SYSTEM AND METHOD FOR CREATING MULTIZONES FROM A SINGLE ZONE HEATING SYSTEM

CROSS-REFERENCE TO RELATED APPLICATIONS

This application claims priority to U.S. Provisional Patent Application Nos. 61/276,657 filed on Sep. 15, 2009 entitled "Creating Multizone from a Single Zone Heating System" and 61/263,374 filed on Nov. 22, 2009 entitled "Creating Multizone from a Single Zone Heating System", which is incorporated fully herein by reference.

TECHNICAL FIELD

The present invention relates to heating and cooling systems and more particularly, relates to systems and methods for converting single zone systems into multizone systems.

BACKGROUND INFORMATION

The majority of existing heating and/or cooling designs in homes and offices are designed as single or multiple zones. For example, in home design, typically an entire home or an entire floor of a home is designed to be in one zone. In this scenario, the temperature on the thermostat on the floor is set to a desired temperature. Once the temperature in the area where the thermostat is installed falls (or raises) below or above a set temperature, the thermostat sends a signal down to the boiler or air conditioner asking to start the heat or air conditioning to that floor. In the case of heat, the boiler starts heating up the water (to a set temp), opens up the valve to that floor and starts pumping the hot water up through that floor which passes through every room in that floor and back down to the boiler. While the hot water is circulated through the pipes passing through heating elements (each room has a section of heating element which may be, for example one or more baseboard heaters or radiant heat pipes) where the heat is given off to the surrounding air next to the heating element and as it does this hot water looses some of its heat. This process continues until the water returns back to the boiler which is heated up again and is sent back to that floor. This process continues until the temperature in the area where the thermostat is installed reaches the set temperature on the thermostat.

The problems with the current one zone systems are numerous. In the existing design, the temperature for all of the rooms on one floor or in the zone is controlled by a single thermostat that is located in a single room in that zone. This approach makes it impossible to have different temperatures in different rooms. For example, in a floor that consists of many rooms, if one or more rooms on that floor are not being used, those rooms will also have to be heated since the entire floor is connected in series by the heating pipes. You can not simply turn off the heat in that room and close the door.

Another problem with this design is that a room that is drafty (not well insulated for example) will be colder that another room that is well insulated. If the thermostat is located in a drafty room or an area where it is closer to a door that is used for outside access every time people enter or exit the temperature in that area will be affected. This causes the call for heat to be premature which causes a big temperature difference between rooms on that floor.

An additional problem with this design is the fact that hot water entering the first room in the circuit is hotter than the hot water entering the last room in the circuit due to loss of heat as the water travels from room to room through the heating elements. As a result, it is not possible in the standard one zone systems to maintain a constant temperature throughout all of the rooms in the zone and it is also not possible to raise or lower the temperature in one of the rooms within the zone independent of the temperature in the remaining rooms.

In order to solve the problems of the single zone systems, each room on a single floor could be placed on its own zone with its own thermostat. In order to achieve this, each room would need its own heating pipe connection from the boiler to the room and back to the boiler and each room would have to have its own thermostat and water circulator. This would cause each room to be its own complete zone. Therefore, if a single floor consisted of 6 rooms there would be 6 separate piping installations required from the boiler and back to the boiler, along with six separate thermostats and six separate hot water circulators. This type of system is seen in some homes, however this design can be prohibitively expensive. In an already constructed home, it would be extremely costly to install a system like this due to the extensive renovations that would be needed to convert a single zone system to a multizone system of this style.

Accordingly, what is needed is a simple system and method of converting a single zone heating system into a multizone system that does not require extensive renovations and does not require extensive new components, such as new piping to and from the boiler. The system should be easily installable, even by a skilled homeowner. The system should be relatively inexpensive and should allow for multiple zones within the home without requiring extensive changes to the current system already in use within the home.

SUMMARY

The present invention features a method of converting a single zone system into a multizone system, wherein the method comprises the acts of retrofitting an existing heating element in at least a first and a second room by adding an input device at one end of the heating element, the input device coupled to an existing hot water pipe on a first end and to the heating element on a second end, wherein the input device includes an RF circuit configured for receiving an RF control signal from a thermostat; installing a bypass pipe, coupled to the input device on the second end and generally providing a hot water path parallel to the heating element; installing an output device, the output device coupled proximate a first end to the bypass pipe and the heating element and coupled proximate a second send to an existing hot water pipe; installing a central thermostat in the first room, wherein the central thermostat comprises a temperature sensing device, temperature setting controls, an RF circuit and control wires to a boiler, the RF circuit for providing the input device RF control signal; and installing at least one peripheral thermostat in the second room, wherein the peripheral thermostat comprises a temperature sensing device, temperature setting controls, a display monitor and an RF circuit, the RF circuit for providing the input device RF control signal.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention and are not to be limited except by the allowed claims and their legal equivalents.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
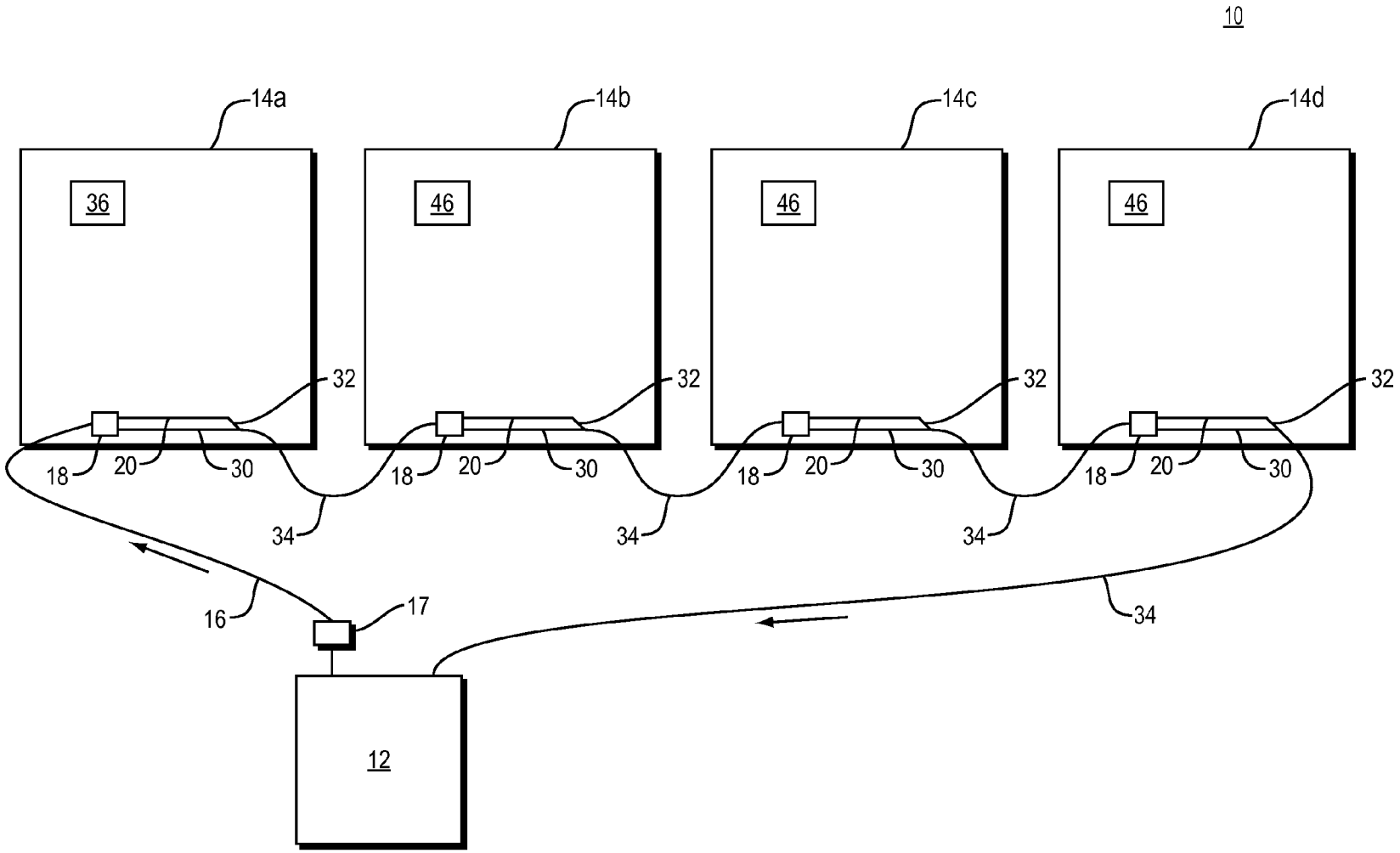
FIG. 1 is a comprehensive view of a multizone forced hot water system of one embodiment of the present invention.
Figure 2A:
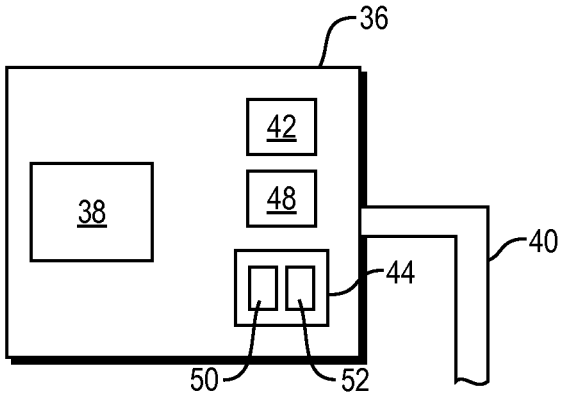
FIG. 2A is a detailed view of the central thermostat embodiment of the present invention.
Figure 2B:
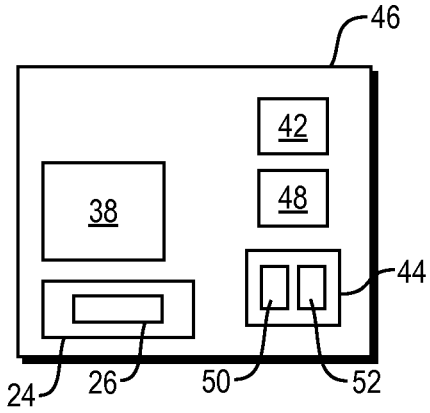
FIG. 2B is a detailed view of the peripheral thermostat of the present invention.
Figure 2C:
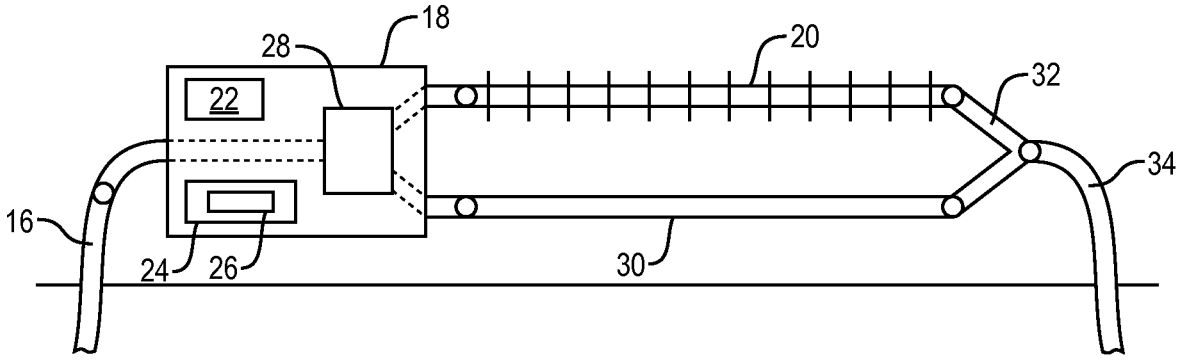
FIG. 2C is a detailed view of one zone within the multizone forced hot water system of one embodiment of the present invention.

The present invention features a multizone conversion system 10 for a forced hot water single zone heating system. The multizone conversion system 10 allows a single zone consisting of multiple rooms or spaces to be divided into a plurality of zones, FIGS. 1 and 2. The multizone conversion system 10 can be installed into a new home or into an older home without the need for major renovations while allowing the existing heating system to be left intact. The multizone conversion system 10 involves designating each room (14*a*, 14*b*, 14*c*, 14*d*, etc.) within a single zone as its own "zone" without the need for additional wiring, new plumbing connections to the main boiler, or other costly construction costs. In a hot water system, the water is heated by a boiler, furnace or other heat generation system 12 and the water is sent to the first room 14*a* of the zone via a hot water output pipe 16.

First, an input device 18 is installed inline with the hot water output pipe 16 in the first room of the zone prior to the heating element 20. The input device 18 attaches to the hot water output pipe 16 and typically comprises an RF circuit (circuit board with RF receiver/transmitter technology) 22, a battery compartment 24 with one or more batteries 26, all of which are used to control a switching valve 28 and provide power to the RF circuit 22. The switching valve 28 can be a two-way valve or any other type of valve designed to control the flow of the water through either the heating element 20 or through a bypass pipe 30. The switching valve contains a connection for connecting to the hot water output pipe 16 on one end and a dual connection on the opposite side for connecting to both the bypass pipe 30 (which would be newly installed in a retrofit situation) and the heating element 20. The bypass pipe 30 could be constructed from copper or a plastic, such as PVC or PEX.

The bypass pipe 30 runs the same length as the heating element 20 in any given section of the heating system. At the end of the heating element 20, an output device 32 is connectable to both the heating element 20 and the bypass pipe 30. The output device 32 is essentially a "Y" connector and serves to connect the two pipes (heating element pipe 20 and bypass pipe 30) into one pipe and allows for attachment to a hot water pipe 34, which will then continue to the next heating element in the single zone system.

An input device 18, bypass pipe 30 and output device 32 are then installed on at least two or more individual heating elements throughout the single zone in order to create a plurality of zones. Each individual zone is controlled by a wired or preferably RF wireless thermostat that controls the input device 18 for a given zone and that is programmed to be responsive to a given thermostat for the room or space. A central or main thermostat 36 is the thermostat that is located where the already existing thermostat is (and replaces the previous single thermostat of that zone) or where the main thermostat will be installed in a new building. This central thermostat 36, FIG. 2A, maintains a wired connection via control wires 40 to a hot water circulator 17 located at or near the boiler 12. The central thermostat 36 may also comprise an LCD monitor or display 38, a temperature sensing device 42, temperature setting controls 48, and an RF circuit 44 which includes an RF transmitter 50 and an RF receiver 52.

The central thermostat controls the temperature of the room in which it is located by sensing the temperature of the room with the temperature sensing device. The central thermostat also displays the current temperature on the LCD monitor, if provided. The temperature setting controls of the central thermostat allow a user to program the temperature and may also allow the user to configure the central thermostat to maintain programmable settings for multiple temperature changes throughout the day and throughout the week.

The central thermostat uses an RF circuit with an RF transmitter and an RF receiver, which allows the central thermostat to communicate not only with the input device located in the same room as the central thermostat, but also with any other installed peripheral thermostats that are located within the same zone. The central thermostat, by means of its RF circuit, is configured to receive an RF signal from one or more of the peripheral thermostats that is calling for heat. This will cause the central thermostat to turn on the zone hot water circulator 17. Hot water will start to flow within the plumbing for that zone and the input device(s) in the room(s) with peripheral thermostats that called for heat will be activated, such that the switching valve will allow heat to flow through the heating element of only those rooms that require heat. The remainder of the room(s) that do not require heat will be controlled by the input device(s) such that the switching valve will direct the flow of the hot water through the bypass pipe, thereby not providing heat to that room(s).

Each additional zone is monitored by a peripheral or secondary thermostat 46. Each peripheral thermostat 46 preferably comprises an LCD monitor or display 38, a temperature sensing device 42, temperature setting controls 48, a battery compartment 24 with one or more batteries 26, and an RF circuit 44 which includes an RF transmitter 50 and an RF receiver 52.

The central thermostat 36 functions as the peripheral thermostat 46 for the room in which the central thermostat is present. As a result, each room has its own thermostat and each thermostat 36/46 is programmable for a temperature that is specific to the particular room using the temperature setting controls 48. The input device 18 of each room communicates with the peripheral thermostat 46 located in the same room and each peripheral thermostat 46 in turn communicates with the central thermostat 36 as described above. The communications occur using the RF circuit 22/44 located within each device. Several methods of communication, such as Bluetooth™ or ZigBee™, are contemplated and are within the scope of the current invention.

In operation, a temperature would be set on each thermostat 36/46 using the temperature setting controls 48. If the temperature in a given room is below the requested temperature setting, the thermostat 36/46 would call for heat. At least one peripheral thermostat 46 would send a wireless request via the RF transmitter 50 of the RF circuit 44 to the RF receiver 52 of the central thermostat 36. The central thermostat 36 would then send the heat request via the control wires 40 to the circulator 17 on the boiler 12. The central thermostat 36 monitors the RF signals from the peripheral thermostats 46. If the temperature in a given room is at or above the requested temperature setting, no heat would be needed or called for.

If a peripheral thermostat 46 in a given room senses that the given room should receive heat, the peripheral thermostat 46 communicates with both the main thermostat 36, to turn on the hot water circulator 17 for that zone, and also communicates with the input device 18 for that room to allow heat to pass through the heating element 20 in that room and to block the bypass pipe 30 using the switching valve 28. If a room should not receive heat, the peripheral thermostat 46 communicates with the input device 18 to allow heat to pass through the bypass pipe 30 and to block the heating element 20 using the switching valve 28. When a request is received from any one of the thermostats 36/46 for heat, the circulator 17 on the boiler 12 receives the request via the central thermostat 36 and begins circulating the heated water to the first room in the series. The thermostat found in each room has already determined whether the room should receive heat (heating element is open and bypass pipe is closed) or the room should not receive heat (heating element is closed and bypass pipe is open). The boiler circulator 17 for that zone will then circulate the hot water through the pipes until the desired temperatures are reached in all of the rooms.

If RF technology is not desirable by the consumer, it is within the scope of this invention that the system could be a wired system. The input device would be connected via wire to the thermostat in the same room and all thermostats would be connected via wire to the central thermostat.

Figure 5:
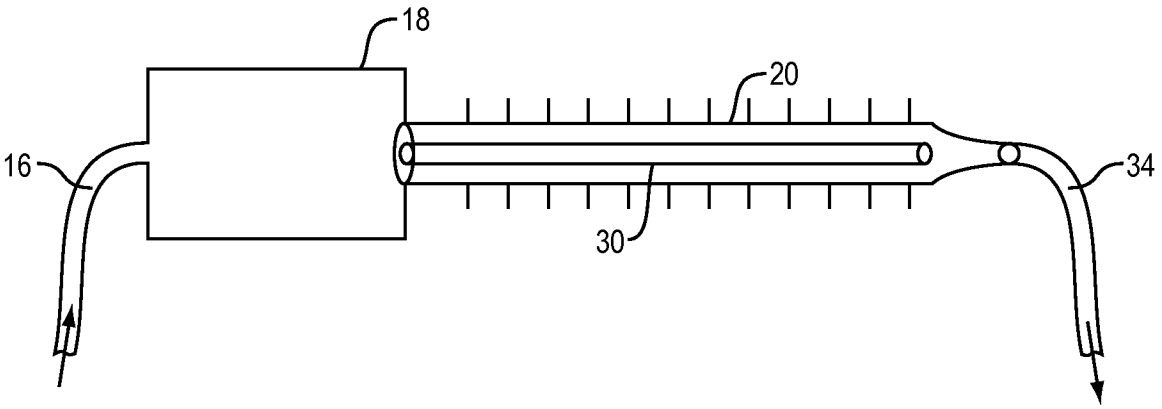
FIG. 5 is a detailed view of one zone within the multizone forced hot water system of another embodiment of the present invention.

In an alternate embodiment of the present invention, FIG. 5, the bypass pipe 30 would be located within the heating element 20. In this embodiment, the hot water would flow through the heating element located around the bypass pipe when heat was needed and when heat was not needed, the hot water would flow through the bypass pipe 30 which is located inside the heating element device. The input device would be modified slightly such that it could be operated to open the path to the bypass pipe or to the outer heating element depending on the temperature requirement. An output device would not be needed in this embodiment of the invention, as the inner bypass pipe 30 and outer heating element 20 would join together and attach to the hot water pipe 34 going to the next room.

Figure 3:
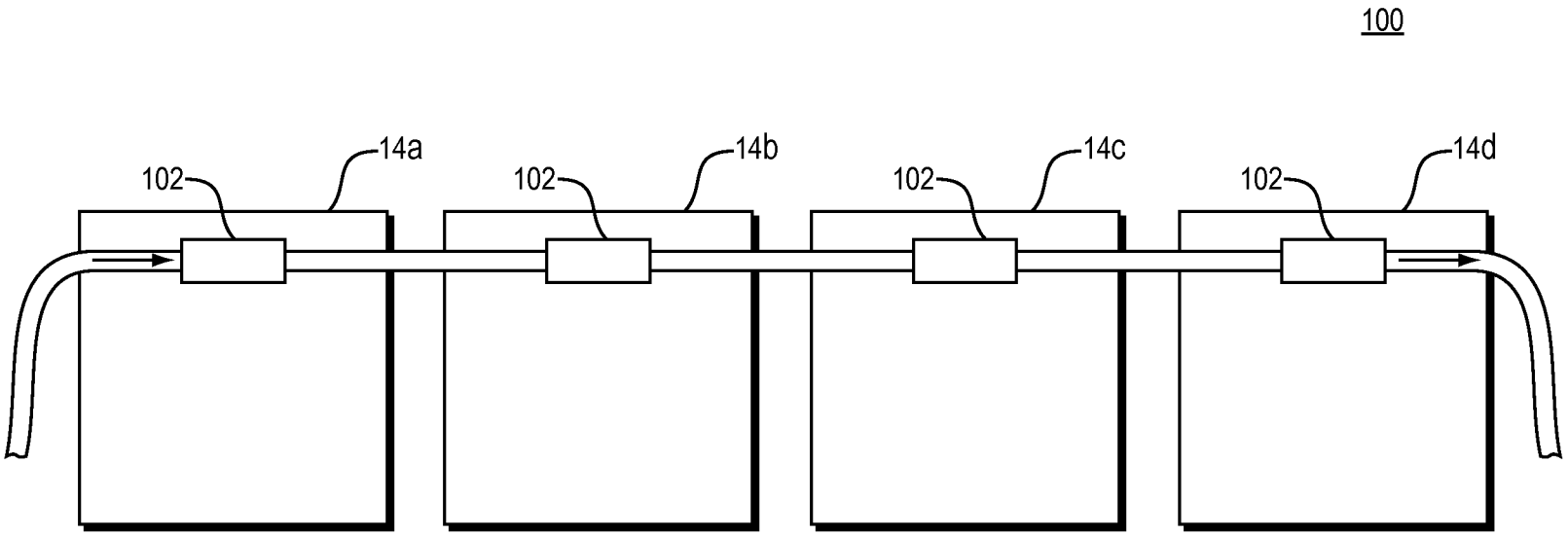
FIG. 3 is a comprehensive view of a multizone forced hot air system of one embodiment of the present invention.
Figure 4A:
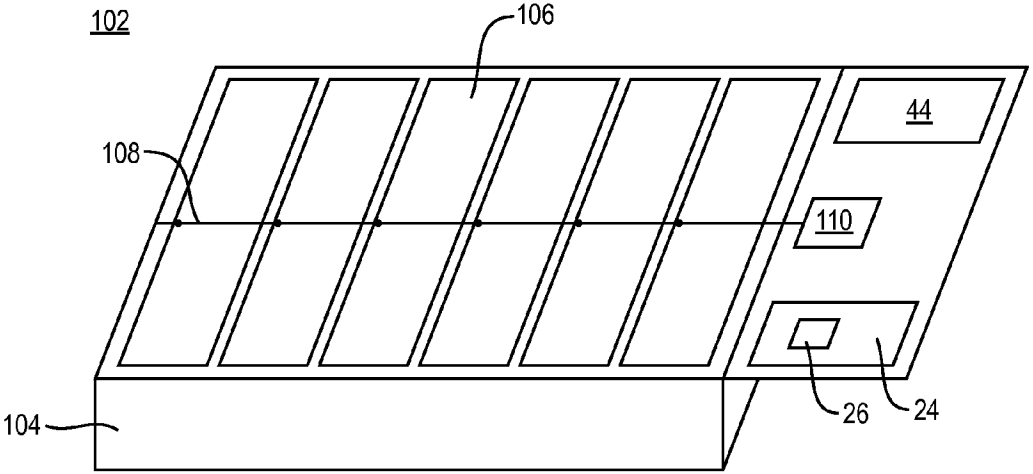
FIG. 4A is a detailed view of one closed zone within the multizone forced hot air system of one embodiment of the present invention.
Figure 4B:
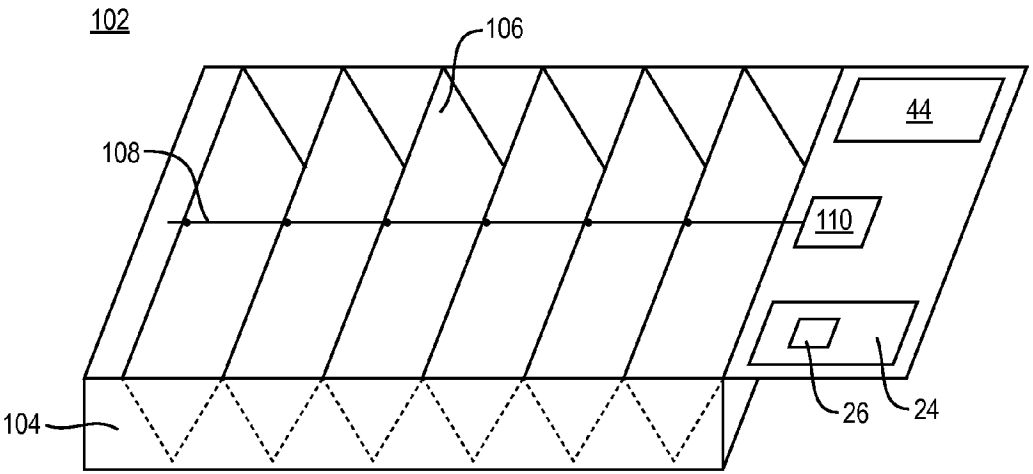
FIG. 4B is a detailed view of one open zone within the multizone forced hot air system of one embodiment of the present invention.

In a further embodiment of the invention, the invention features a multizone conversion system 100, FIG. 3, for a forced hot air single zone system. The multizone conversion system 100 allows a single zone consisting of multiple rooms or spaces to be divided into a plurality of zones, FIGS. 3 and 4. The multizone conversion system 100 can be installed into a new home or into an older home without the need for major renovations while allowing the existing heating system to be left in tact. The multizone conversion system 100 involves the installation of a series of devices into each room (14*a*, 14*b*, 14*c*, etc.), which is to be designated as its own zone. The multizone conversion system 100 features a replacement forced air dispensing register device 102. The register device 102 replaces the existing register and is comprised of a rectangular box 104, FIG. 4, which has a plurality of fins or blades 106 that are coupled together in the middle of the fins or at either end with a shaft 108 such that the fins are free to move up or down. When the fins move up (horizontal) they close or block the opening in the rectangular box such that there is no opening for any air to pass through, FIG. 4A. When the fins are moved downward (disposed vertically) they create a series of gaps between one another, thereby creating space for air to pass through the fins and into the room, FIG. 4B. The shaft 108 is controlled by a motor or solenoid 110. The motor/solenoid 110 is configured to control the operation of the shaft 108 to open and close the fins 106 as needed. The register device 102 also comprises an RF circuit 44 which will receive signals from the thermostat 36/46 and activate the motor 110 to either open or close the fins 106. The register device 102 also features a battery compartment 24 and one or more batteries 26 that provide power for the RF circuit 44 and the motor 110. In another embodiment of the present invention, the register device 102 could be hardwired to a power source and/or thermostat.

The multizone conversion system 100 for forced hot air is operated in a very similar manner as the multizone conversion system 10 for forced hot water already discussed above. Each room will contain its own thermostat. The old registers in the room register will be removed and replaced by the replacement register device 102. The existing thermostat will be replaced with a central thermostat 36 and each additional room or space will be outfitted with a peripheral thermostat 46. The multizone conversion system 100 can also be used with central air conditioning systems in the same manner, thereby allowing each room to be its own zone.

Modifications and substitutions by one of ordinary skill in the art are considered to be within the scope of the present invention, which is not to be limited except by the following claims.

The invention claimed is:

1. A method of converting a single zone system into a multizone system, wherein the method comprises the acts of:

retrofitting an existing heating element in at least a first and a second room by adding an input device at one end of the heating element, the input device coupled to an existing hot water pipe on a first end and to the heating element on a second end, wherein the input device includes an RF circuit configured for receiving an RF control signal from a thermostat;

installing a bypass pipe, coupled to the input device on the second end and generally providing a hot water path parallel to the heating element;

installing an output device, the output device coupled proximate a first end to the bypass pipe and the heating element and coupled proximate a second end to an existing hot water pipe;

installing a central thermostat in the first room, wherein the central thermostat comprises a temperature sensing device, temperature setting controls and an RF circuit, wherein the RF circuit provides the input device RF control signal and for receiving RF signals from peripheral thermostats, the central thermostat configured for providing the input device RF control signal for the input device controlling heat in said first room, and responsive to said temperature sensing device in said central thermostat and to an RF signal from one or more peripheral thermostats, for providing a signal to said boiler causing said boiler to provide hot water to said single zone heating system; and installing at least one peripheral thermostat in the second room, wherein the peripheral thermostat comprises a temperature sensing device, temperature setting controls and an RF circuit, the RF circuit configured for providing the input device located in the second room with an RF control signal and for providing an RF signal to said central thermostat.

2. The method of claim 1, wherein the central thermostat communicates wirelessly via an RF control signal with the input device located in the first room to control a temperature of the first room, and wherein the peripheral thermostat communicates wirelessly via an RF control signal with the input device in the second room and the central thermostat to control a temperature in the second room.

3. The method of claim 1, further comprising a switching valve located within the input device and controlled by the input device, wherein the switching valve is designed to control the flow of water through either the bypass pipe or the heating element based upon a wireless communication received from either the central thermostat or the peripheral thermostat.

4. The method of claim 3, wherein the switching valve will direct water through the bypass pipe when heat is not needed.

5. The method claim 3, wherein the switching valve will direct water through the heating element when heat is needed.

6. A multizone conversion system configured for converting a single zone into a plurality of zones, wherein the multizone conversion system comprises:

an input device configured to attach between a hot water pipe and a first end of a heating element, wherein the input device comprises an RF circuit, a battery compartment with one or more batteries, and a switching valve;

a bypass pipe configured to attach on a first end to the switching valve of the input device;

an output device configured to attach on a first side to a second end of the heating element and a second end of the bypass pipe and also configured to attach on a second side to a hot water pipe; and a thermostat located in each room within a single zone heating system, wherein the thermostat comprises a temperature sensing device, temperature setting controls, an RF circuit and a display, wherein the thermostat is configured to control the input device located in the same room by wireless communication.

7. The system of claim 6, wherein a wireless signal sent by an RF transmitter in the RF circuit of the thermostat for heat to an RF receiver of the RF circuit of the input device would cause the switching valve to open the heating element and close the bypass pipe.

8. The system of claim 6, wherein a wireless signal sent by an RF transmitter in the RF circuit of the thermostat that heat was no longer required to an RF receiver of the RF circuit of the input device would cause the switching valve to open the bypass pipe and close the heating element.

9. A method of converting a single zone system into a multizone system, wherein the method comprises the acts of:

retrofitting an existing heating element in at least a first and a second room by adding an input device at one end of the heating element, the input device including one input proximate a first end, and two outputs proximate a second end, said input device configured for receiving an RF signal from a thermostat for causing said input device to fluidly couple one of said two outputs to said input, the input device coupled to an existing hot water pipe at said input on said first end and to the heating element on one of said outputs on said second end;

installing a bypass pipe, coupled to the other of said two outputs of said input device on the second end, for generally providing a hot water path parallel to the heating element;

installing an output device, the output device coupled proximate a first end to the bypass pipe and the heating element and coupled proximate a second end to an existing hot water pipe;

installing a central thermostat in the first room, wherein the central thermostat comprises a temperature sensing device, temperature setting controls and an RF circuit, the RF circuit for providing the input device RF control signal and for receiving RF signals from peripheral thermostats, said central thermostat configured for providing the input device RF control signal for the input device controlling heat in said first room, and responsive to said temperature sensing device in said central thermostat and to an RF signal from one or more peripheral thermostats, for providing a signal to said boiler causing said boiler to provide hot water to said single zone heating system; and installing at least one peripheral thermostat in the second room, wherein the peripheral thermostat comprises a temperature sensing device, temperature setting controls and an RF circuit, the RF circuit configured for providing the input device RF control signal and for providing an RF signal to said central thermostat indicating heat is required in an area adjacent said peripheral thermostat.

* * * * *